US011308930B2

(12) United States Patent
Uchimura et al.

(10) Patent No.: US 11,308,930 B2
(45) Date of Patent: Apr. 19, 2022

(54) ELECTRONIC HORN

(71) Applicant: IMASEN ELECTRIC INDUSTRIAL CO., LTD., Inuyama (JP)

(72) Inventors: Katsunori Uchimura, Nagoya (JP); Koichi Toyama, Nagoya (JP); Junjiro Yoshimura, Nagoya (JP); Toshihiko Kawamura, Nagoya (JP); Yoshio Miyata, Nagoya (JP)

(73) Assignee: IMASEN ELECTRIC INDUSTRIAL CO., LTD., Inuyama (JP)

( * ) Notice: Subject to any disclaimer, the term of this patent is extended or adjusted under 35 U.S.C. 154(b) by 113 days.

(21) Appl. No.: 16/761,999

(22) PCT Filed: Nov. 9, 2017

(86) PCT No.: PCT/JP2017/040425
§ 371 (c)(1),
(2) Date: May 6, 2020

(87) PCT Pub. No.: WO2019/092828
PCT Pub. Date: May 16, 2019

(65) Prior Publication Data

US 2020/0320970 A1 Oct. 8, 2020

(51) Int. Cl.
*H04R 1/28* (2006.01)
*G10K 9/122* (2006.01)
*H04R 17/10* (2006.01)

(52) U.S. Cl.
CPC ..... *G10K 9/122* (2013.01); *H04R 17/10* (2013.01)

(58) Field of Classification Search
CPC ..... H04R 1/28; H04R 1/2803; H04R 1/2807; H04R 1/2811; H04R 1/30; H04R 17/00; H04R 17/005
See application file for complete search history.

(56) References Cited

U.S. PATENT DOCUMENTS 1,904,759 A 4/1933 Henry
5,012,221 A 4/1991 Neuhaus et al.
(Continued)

FOREIGN PATENT DOCUMENTS

CN 101079173 A 11/2007
EP 0749900 A1 * 12/1996 ..... B29C 66/8145
(Continued)

OTHER PUBLICATIONS

English translation of the International Search Report dated Jan. 30, 2018 for parent application No. PCT/JP2017/040425.
(Continued)

*Primary Examiner* — Ryan Robinson
(74) *Attorney, Agent, or Firm* — J-Tek Law PLLC; Jeffrey D. Tekanic; Scott T. Wakeman

(57) ABSTRACT

An electronic horn for use, e.g., in a vehicle, includes a piezoelectric element (52) that excites a plate-shaped oscillator (51). A resonator (7) is provided with an opening (71) and covers forward of the oscillator such that a resonance space (S) is defined between the resonator and the oscillator. An inner cylinder (62) and an outer conical housing (63) are provided concentrically around the resonator. A circular cover (8) covers the inner cylinder (62) and the outer conical housing (63) from the front, such that a buffer chamber (BR), at least one first sound amplifying chamber (MH1), and a second sound amplifying chamber (MH2) are defined around an entire circumference of the opening of the resonator.

21 Claims, 5 Drawing Sheets

(56) References Cited

U.S. PATENT DOCUMENTS

| | | | | |
|---|---|---|---|---|
| 5,293,149 | A | 3/1994 | Wilson et al. | |
| 6,356,642 | B1 * | 3/2002 | Nakamura | H04R 1/02 181/144 |
| 8,598,997 | B2 | 12/2013 | Hayashi et al. | |
| 9,950,663 | B2 | 4/2018 | Toyama et al. | |
| 2003/0228021 | A1 | 12/2003 | Letinturier et al. | |
| 2007/0057778 | A1 | 3/2007 | Prince et al. | |
| 2008/0180230 | A1 | 7/2008 | Zimmermann | |
| 2010/0119096 | A1 | 5/2010 | Suzuki | |
| 2012/0182137 | A1 | 7/2012 | Nakayama et al. | |
| 2013/0093578 | A1 | 4/2013 | Goto | |
| 2014/0269211 | A1 * | 9/2014 | Graber | G10K 11/025 367/174 |
| 2017/0028910 | A1 | 2/2017 | Toyama et al. | |
| 2020/0066243 | A1 | 2/2020 | Uchimura et al. | |

FOREIGN PATENT DOCUMENTS

| | | | | |
|---|---|---|---|---|
| GB | 2145905 | A * | 4/1985 | G10K 9/122 |
| GB | 2322502 | A * | 8/1998 | G10K 9/122 |
| GB | 2354903 | A | 4/2001 | |
| JP | S5547007 | U | 3/1980 | |
| JP | S5713490 | A | 1/1982 | |
| JP | S58162994 | A | 9/1983 | |
| JP | H0255297 | U | 4/1990 | |
| JP | H04119497 | U | 10/1992 | |
| JP | H0678998 | U | 11/1994 | |
| JP | H07222284 | A | 8/1995 | |
| JP | H10207466 | A | 8/1998 | |
| JP | 2007316450 | A | 12/2007 | |
| JP | 2012148657 | A | 8/2012 | |
| WO | 2015145659 | A1 | 10/2015 | |
| WO | 2015167572 | A1 | 11/2015 | |
| WO | 2015186239 | A1 | 12/2015 | |
| WO | 2018159490 | A1 | 9/2018 | |

OTHER PUBLICATIONS

English translation of the Written Opinion of the International Searching Authority for parent application No. PCT/JP2017/040425.

* cited by examiner

ELECTRONIC HORN

The present application is the US national stage of International application serial no. PCT/JP2017/040425 filed on Nov. 9, 2017.

TECHNICAL FIELD

The present invention generally relates to an electronic horn, e.g. for vehicles, and in certain embodiments, to an electronic horn capable of providing a sufficient warning sound output with a compact shape.

BACKGROUND ART

Because an electronic horn emits a warning sound by causing a piezoelectric element to excite a plate-like oscillator, it is characterized by its compactness, longevity, etc. as compared to conventional electromagnetic horns. However, because the warning sound generated from the oscillator is relatively soft (small), it is usually amplified by a resonator before being output. Furthermore, in Japanese Patent Laid-Open Publication No. 2010-157886, a plate-shaped horn cap is provided forward of the resonator so that the directivity of the output sound can be adjusted according to the manner in which the electronic horn is used.

SUMMARY OF THE INVENTION

However, a plate-shaped horn cap suffers from that problem in that it has been hitherto difficult to efficiently output the warning sound, which is output from the resonator, forwardly with sufficient directivity.

Therefore, it is one non-limiting object of the present teachings to disclose a compact electronic horn that can output a warning sound forwardly with sufficient directivity.

In a first aspect of the present disclosure, an electronic horn, e.g., for a vehicle, includes: a plate-shaped oscillator (51); a piezoelectric element (52) that excites the oscillator (51); a resonator (7) provided with an opening (71) in a portion thereof and covering forward of the oscillator (51) such that a resonance space (S) is defined between the resonator (7) and the oscillator (51); a buffer chamber (BR) that communicates with the resonance space (S) via the opening (71); one or more first sound amplifying chambers (MH1) that guide(s) a warning sound, which is output from (through 0 the buffer chamber (BR), to the front or to the rear of an outer circumference along a path that inversely curves while gradually increasing in diameter; and a second sound amplifying chamber (MH2) that further reflects the warning sound, which has been guided to the rear of the outer circumference via the first sound amplifying chamber(s) (MH1), to the front of the outer circumference.

In the first aspect, the warning sound, which has been output from the opening of the resonator, is efficiently output forwardly with sufficient directivity while being resonantly amplified by the megaphone effect of the one or more first sound amplifying chambers and the subsequent second sound amplifying chamber. In such an embodiment, because the one or more first sound amplifying chambers, as well as the first sound amplifying chamber(s) and the second sound amplifying chamber, which exhibit the megaphone effect, are coupled in series in the radial direction via the path that inversely curves, the horn body does not greatly protrude in the forward-rearward direction and thus has a compact shape in the forward-rearward direction.

In a second aspect of the present teachings, an inner cylinder (62) and an outer conical housing (63), which are respectively located inside and outside with regard to the forward direction of the resonator (7) are provided, a circular cover (8) is further provided so as to cover the inner cylinder (62) and the outer conical housing (63) from the front direction, and thereby the buffer chamber (BR), the first sound amplifying chamber(s) (MH1), and the second sound amplifying chamber (MH2) are formed, around an entire circumference of the opening (71) of the resonator (7), by the cover (8) and the walls of the inner cylinder (62) and the outer conical housing (63).

In the second aspect, because the first sound amplifying chamber(s) and the second sound amplifying chamber are provided around the entire circumference, the warning sound can be output forwardly efficiently and with more directivity.

In a third aspect of the present teachings, a plate surface outer peripheral edge (53) of the plate-shaped oscillator (51) is supported by sandwiching it on (from) both sides, and an outer peripheral end (511) of the oscillator (51) is located in a spaced apart manner from a wall inner surface (241) of the horn body.

In the third aspect, even if the temperature around the horn increases or decreases and the oscillator or the wall inner surface of the horn body expands or contracts, because the outer peripheral end of the oscillator does not contact the wall inner surface of the horn body, compression or tensile stress does not occur within the plate of the oscillator and its amplitude does not change.

The reference numerals in parentheses above merely show a representative, non-limiting correspondence relationship with specific structures described in the below described embodiment, and are not limiting of the scope of the present invention.

As described above, according to electronic horns of the present disclosure, it is possible to output a warning sound forward with sufficient directivity and to make the horn body compact in a front-rear direction.

DETAILED DESCRIPTION OF THE INVENTION

It is noted that the embodiments, which will be described below, are merely examples of the present disclosure and various design improvements implemented by those skilled in the art without departing from the spirit and scope of the present invention are also included in the scope of the present invention.

First Embodiment

Figure 1:
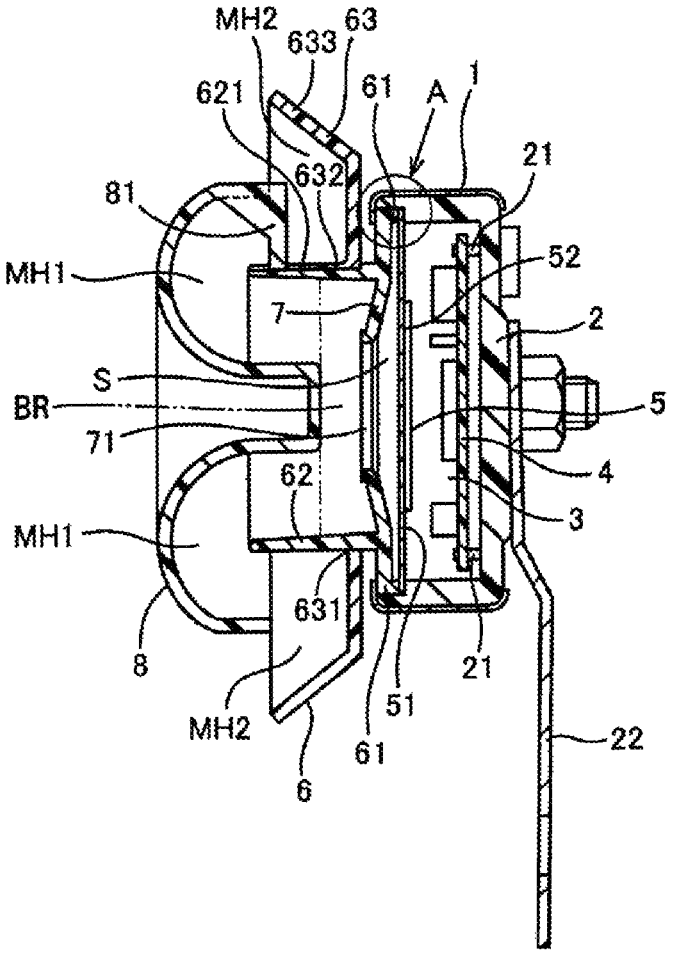
FIG. 1 is a sectional view of an electronic horn of one embodiment of the present teachings and is a sectional view taken along a line I-I in FIG. 2.
Figure 2:
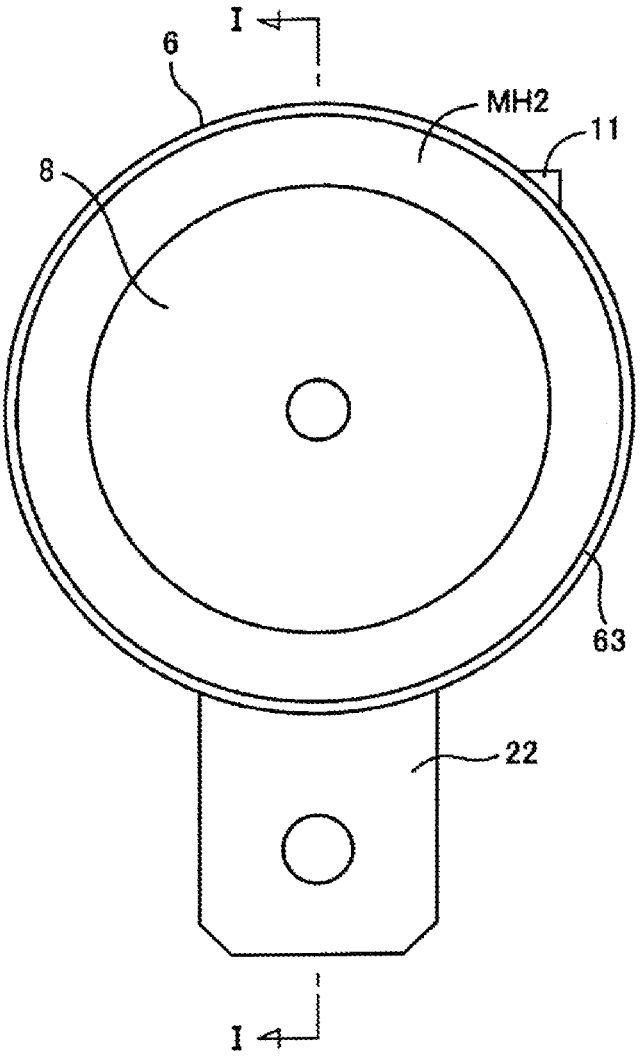
FIG. 2 is a front view of the electronic horn.
Figure 3:
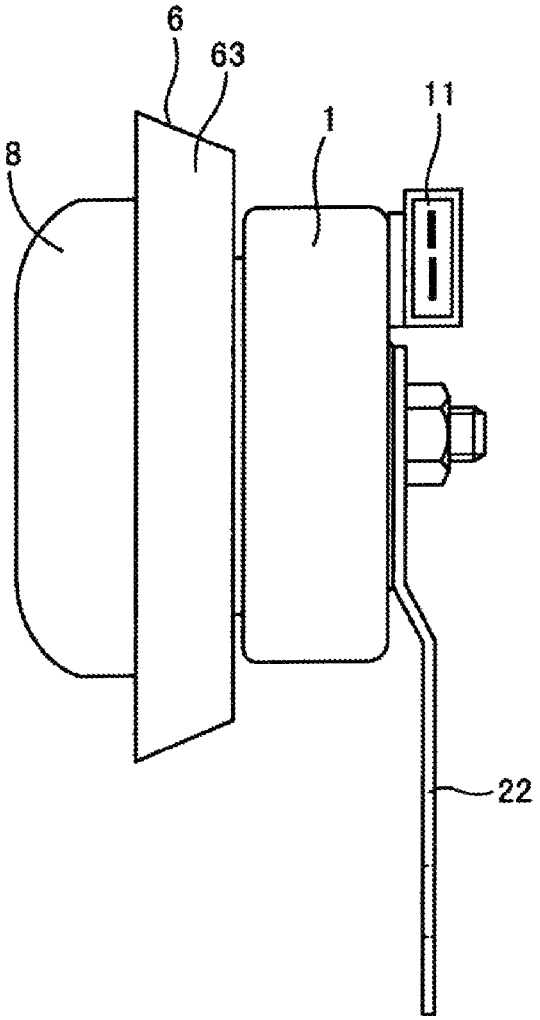
FIG. 3 is a side view of the electronic horn.

FIG. 1 shows an entire sectional view of an electronic horn, FIG. 2 shows a front view thereof, and FIG. 3 shows a side view thereof. A horn body includes a metal plate casing 1 having a cylindrical shape that opens in the forward-rearward direction (left-right direction in FIG. 1) when the horn body is installed in a vehicle. A resin (polymer) holder 2 having a container shape that opens forward is held in the cylinder of the casing 1, and a circuit board 4 provided with a warning sound circuit 3, which is constituted by a warning signal generator circuit, an amplifier circuit, and the like, is disposed on a bottom wall of the holder 2 in parallel with the bottom wall. The circuit board 4 is supported by a plurality of spacers 21 extending perpendicular from the bottom wall of the holder 2. A mounting stay 22 is bolted onto an outer surface of the bottom wall of the holder 2.

Figure 4:
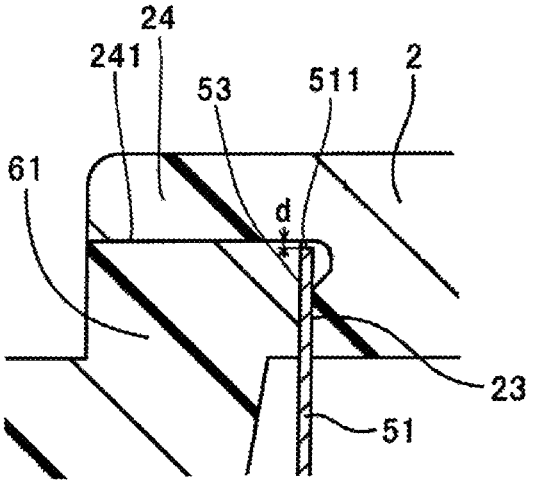
FIG. 4 is a sectional view of an oscillator clamped portion and is an enlarged sectional view of a part A in FIG. 1.

A oscillator 51 made of a metal plate and constituting, together with a piezoelectric element 52 described below, a piezoelectric sound generator 5 is stretched in parallel with the circuit board 4 while closing the opening of the holder 2. An outer peripheral end portion 53 of the oscillator 51 is sandwiched between an opening edge 23 of the holder 2 and an outer peripheral end portion 61 of a resin (polymer) intermediate element 6, which has been attached so as to cover the opening of the holder 2. Details of the clamped portion are shown in FIG. 4. In FIG. 4, the opening edge 23 is recessed in a stepped manner within the holder 2 and contacts the outer peripheral portion 53 of the oscillator 51. The entire periphery of the outer peripheral portion of the opening edge 23 forms an open standing wall 24 that contacts an outer periphery of the outer peripheral edge 61 of the intermediate element 6 while being separated (spaced apart) from the outer peripheral end portion 53 of the oscillator 5. More particularly, an outer peripheral edge 511 of the oscillator 5 is located in a spaced apart manner inward from an inner surface 241 of the standing wall 24 with a gap d between the outer peripheral edge 511 and the inner surface 241. Thereby, even if the temperature around the horn increases or decreases and the oscillator 51 or the inner surface 241 of the standing wall 24 expands or contracts, the outer peripheral edge 511 of the oscillator 51 does not contact the wall inner surface 241 of the horn body. Thereby, it is possible to avoid a problem, in which compression or tensile stress occurs within the plate of the oscillator 51 due to a temperature increase or decrease and the amplitude of the oscillator 51 changes.

In FIG. 1, the circular piezoelectric element 52 is adhered to the center part of a rear surface of the oscillator 51, and output lines (not shown) respectively extend from the circuit board 4 to one electrode (not shown) of the piezoelectric element 52 and to the oscillator 51 that leads to the other electrode (not shown) of the piezoelectric element 52. In addition, the warning sound circuit 3 on the circuit board 4 is connected to a power supply connector 11 (FIG. 3) provided outside the casing 1.

The above-mentioned intermediate element 6 is equipped with an inner cylinder 62 and an outer conical housing 63. The inner cylinder 62 is formed in a relatively deep container shape that opens forward, and its bottom wall extends radially outward to form the outer peripheral edge 61. Furthermore, the outer peripheral edge 61 is attached so as to cover the opening of the holder 2 while sandwiching and pressing the outer peripheral edge of the oscillator 51 and is affixed by crimping the opening edge of the casing 1 there. The bottom wall of the inner cylinder 62 is bent so as to protrude into the cylinder in a chevron shape, and forms a resonator 7, whereby a resonance space S is formed between the bottom wall of the inner cylinder 62 and the oscillator 51. A circular opening 71 is formed at the peak of the bottom wall forming the resonator 7.

The periphery of the inner cylinder 62 is surrounded by the outer conical housing 63. The outer conical housing 63 has a relatively shallow container shape, and an opening 631 of its bottom wall is fitted onto the outer periphery of the cylindrical wall of the inner cylinder 62. That is, ribs 632 are formed on the outer cylinder 63 at three places on the peripheral edge of the opening 631, and the ribs 632 are fitted into a groove 621 extending in a cylindrical axis direction formed at three circumferential places on the cylindrical wall outer periphery of the inner cylinder 62. An outer peripheral conical wall 633 of the outer conical housing 63 widens outwardly in the forward direction, thereby constituting a reflector as a whole.

A cover 8 is provided to cover a portion of the front of the intermediate element 6. The cover 8 has a circular shape with a diameter smaller than the outer conical housing 63; its center part is greatly depressed toward the bottom wall opening 71 of the inner cylinder 62, and its outer peripheral portion has a cross-sectional shape curved in a substantially arc shape. The outer peripheral edge of the cover 8 reaches (is disposed at) an intermediate position between the walls of the inner cylinder 62 and the outer conical housing 63. Stay portions 81, which extend inward, are formed to project at three circumferential places on the outer peripheral edge of the cover 8, and the tips of the stay portions 81 are fitted into the groove 621 of the cylindrical wall outer periphery of the inner cylinder 62.

The above-described structure includes the following spaces: (i) a buffer chamber BR (the space delimited by the dot-dash line in FIG. 1) having a predetermined volume that communicates with the resonance space S via the opening 71, (ii) a first sound amplifying chamber MH1 that guides a warning sound, which is output from the buffer chamber BR, toward the rear (with regard to the outer circumference direction, i.e. rightward in FIG. 1) via a path that inversely curves while gradually increasing in diameter, and (iii) a second sound amplifying chamber MH2 that further reflects the warning sound, which has been guided rearward by the first sound amplifying chamber MH1, toward the front (with regard to the outer circumference direction, i.e. leftward in FIG. 1). The first and second sound amplifying chambers MH1, MH2 are formed around the entire circumference in the electronic horn between the inner cylinder 62 and the cover 8.

When an output signal of the warning sound circuit 3 is input into the piezoelectric sound generator 5, a sound output is emitted from the piezoelectric sound generator 5. A specific frequency component of this sound output, which is suitable for warning, is amplified in (by) the resonator 7. The amplified warning sound is output via the opening 71 to the buffer chamber BR and then arrives in the first sound amplifying chamber MH1. Then, amplified warning sound is guided along the path, which inversely curves while gradually increasing in diameter, of the first sound amplifying chamber MH1, changes its direction to the rear of the radially outward direction, and enters into the second sound amplifying chamber MH2. After being reflected by the second sound amplifying chamber MH2, the amplified warning sound is output forwardly with regard to the radially outward direction.

In this way, the warning sound output from the resonator 7 is efficiently outputted forwardly with sufficient directivity while being resonance amplified owing to the megaphone effect of the first sound amplifying chamber MH1 and the subsequent second sound amplifying chamber MH2. Furthermore, in the present embodiment, because the first sound amplifying chamber MH1 and the second sound amplifying chamber MH2, which exhibit the megaphone effect, are coupled in series in the radial direction by the path that inversely curves, the horn body has a compact shape without protruding considerably in the forward/rearward direction.

Second Embodiment

Figure 5:
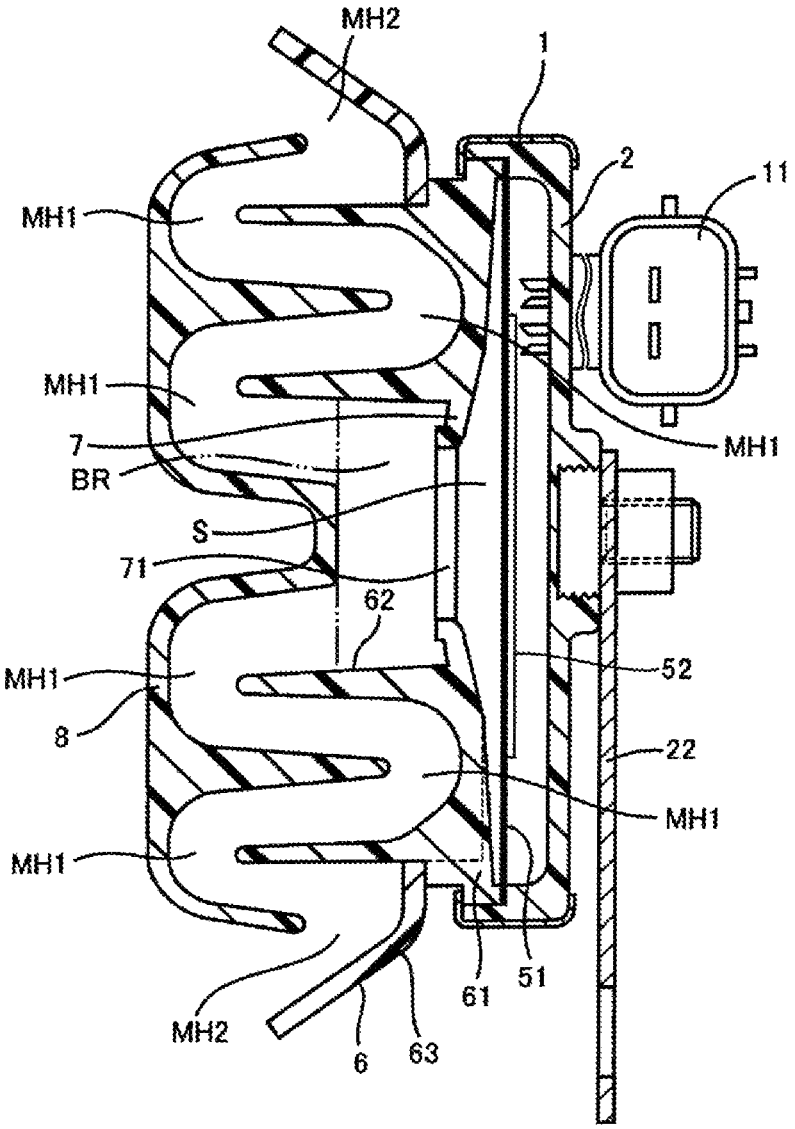
FIG. 5 is a sectional view of an electronic horn of another embodiment of the present teachings.

In the above-described first embodiment, one first sound amplifying chamber MH1 is provided. However, in a second embodiment of the present disclosure, three first sound amplifying chambers MH1 are provided in series as shown in FIG. 5. Therefore, if a warning sound, which has been guided through the downstream-most first sound amplifying chamber MH1 and changed its direction rearward of the radially outward direction, is reflected and output forward of the radially outward direction through the second sound amplifying chamber MH2, a warning sound that excels in directivity and has good sound quality can be further obtained. In the second embodiment, the warning sound circuit may be provided outside the main body of the warning device. It is noted that, in FIG. 5, the same structural elements as those in the first embodiment are assigned the same reference symbols. In addition, it is noted that an odd number (five or more) of the first sound amplifying chambers MH1 may be provided or the number may be an even number.

REFERENCE SYMBOLS LIST

1 Casing
2 Holder
3 Warning sound circuit
4 Circuit board
5 Piezoelectric sound generator
51 Oscillator
52 Piezoelectric element
6 Intermediate element
62 Inner cylinder
63 Outer conical housing
7 Resonator
1 Opening
8 Cover
BR Buffer chamber
MH1 First sound amplifying chamber
MH2 Second sound amplifying chamber
S Resonance space

The invention claimed is:

1. An electronic horn comprising:

a plate-shaped oscillator;

a piezoelectric element configured to excite the oscillator;

a resonator having an opening, the resonator at least partially covering one side of the oscillator and a resonance space being defined between a first side of the resonator and the oscillator;

a buffer chamber that communicates with the resonance space via the opening;

at least one first sound amplifying chamber configured to guide a warning sound, which is output through the buffer chamber, the at least one first sound amplifying chamber having a first portion that extends away from the buffer chamber in a first direction and a second portion that inversely curves in a second direction opposite of the first direction and radially outwardly relative to the first portion while gradually increasing in diameter;

a second sound amplifying chamber configured to further reflect and guide the warning sound, which has been guided by the first sound amplifying chamber, in the first direction;

an inner cylinder disposed radially outward of the resonator;

an outer conical housing disposed radially outward of the resonator; and a circular cover covering the inner cylinder and at least partially covering the outer conical housing in the first direction;

wherein the buffer chamber, the at least one first sound amplifying chamber, and the second sound amplifying chamber are defined by the cover and the cylindrical walls of the inner cylinder and the outer conical housing such that the at least one first sound amplifying chamber and the second sound amplifying chamber extend around an entire circumference of the opening of the resonator.

2. The electronic horn according to claim 1, further comprising:

a horn body having a cylindrical wall and a recessed support surface extending radially inward and perpendicular from the cylindrical wall, wherein:

an outer peripheral end portion of the plate-shaped oscillator is supported by being clamped against the recessed support surface of the horn body, and an outer peripheral edge of the plate-shaped oscillator is spaced apart from the cylindrical wall of the horn body.

3. The electronic horn according to claim 1, wherein the at least one first sound amplifying chamber comprises three first sound amplifying chambers in series that inversely curve in the first and second directions before reaching the second sound amplifying chamber.

4. The electronic horn according to claim 3, wherein the buffer chamber, the three first sound amplifying chambers, and the second sound amplifying chamber are defined by the cover and the walls of the inner cylinder and the outer conical housing such that the three first sound amplifying chambers and the second sound amplifying chamber extend around the entire circumference of the opening of the resonator.

5. The electronic horn according to claim 4, further comprising:

a horn body having a cylindrical wall and a recessed support surface extending radially inward and perpendicular from the cylindrical wall, wherein:

an outer peripheral end portion of the plate-shaped oscillator is supported by being clamped against the recessed support surface of the horn body, and an outer peripheral edge of the plate-shaped oscillator is spaced apart from the cylindrical wall of the horn body.

6. The electronic horn according to claim 5, further comprising:

an intermediate element defining the resonator and clamping the outer peripheral end portion of the plate-shaped oscillator against the recessed support surface of the horn body.

7. The electronic horn according to claim 6, wherein:

the inner cylinder is formed on the intermediate element and comprises two concentric cylinder walls that project from a base of the inner cylinder in the first direction, and the circular cover includes a cylindrical projection that extends in the second direction and projects at least partially between the two concentric cylinder walls of the inner cylinder.

8. The electronic horn according to claim 1, wherein a central portion of the circular cover projects in the second direction and at least partially into a space defined by the inner cylinder.

9. An electronic horn comprising:

a plate-shaped oscillator;

a piezoelectric element configured to excite the oscillator;

an intermediate element defining at least (i) a resonator having an opening and (ii) an inner cylinder surrounding the opening and projecting in a first direction, the resonator at least partially covering one side of the oscillator, a resonance space being defined between a first side of the resonator and the oscillator, and a buffer chamber being defined by a second side of the resonator and the inner cylinder;

at least one first sound amplifying chamber in fluid communication with the buffer chamber and being configured to amplify and guide a warning sound generated by the oscillator, the at least one first sound amplifying chamber having a first portion extending in the first direction and a second portion in fluid communication with the first portion that causes the warning sound to move in a second direction, the second portion being disposed at least partially radially outward of the first portion;

a second sound amplifying chamber disposed at least partially radially outward of the at least one first sound amplifying chamber and being configured further amplify and guide the warning sound from the at least one first sound amplifying chamber, the second sound amplifying chamber having a first portion that receives the warning sound moving in the second direction and a second portion in fluid communication with the first portion that causes the warning sound to move in the first direction, the second portion being disposed at least partially radially outward of the first portion; and a circular cover covering the inner cylinder and at least partially covering an outer conical housing in the first direction, the second portion of the second sound amplifying chamber being defined, in part, by the conical outer housing disposed radially outward of the inner cylinder;

wherein the buffer chamber, the at least first sound amplifying chamber, and the second sound amplifying chamber are defined by the cover and the walls of the inner cylinder and the outer conical housing such that the at least one first sound amplifying chamber and the second sound amplifying chamber extend around an entire circumference of the opening of the resonator.

10. The electronic horn according to claim 9, wherein a central portion of the circular cover projects in the second direction and at least partially into a space defined by the inner cylinder.

11. The electronic horn according to claim 10, wherein:

the inner cylinder comprises two concentric cylinder walls that project from a base of the inner cylinder in the first direction, and the circular cover further includes a cylindrical projection that extends in the second direction and projects at least partially between the two concentric cylinder walls of the inner cylinder, the cylindrical projection of the circular cover being concentric to the central portion of the circular cover that projects in the second direction and at least partially into the space defined by a radially inward-most one of the two concentric cylinder walls of the inner cylinder.

12. The electronic horn according to claim 11, wherein the at least one first sound amplifying chamber comprises three first sound amplifying chambers in series that inversely curve in the first and second directions before reaching the second sound amplifying chamber, the three first sound amplifying chambers being defined at least in part by the two concentric cylinder walls of the inner cylinder, the circular cover, the central portion of the circular cover and the cylindrical projection of the cover.

13. The electronic horn according to claim 12, further comprising:

a horn body having a cylindrical wall and a recessed support surface extending radially inward and perpendicular from the cylindrical wall, wherein:

an outer peripheral end portion of the plate-shaped oscillator is clamped between the intermediate element and the recessed support surface of the horn body, and an outer peripheral edge of the plate-shaped oscillator is spaced apart from the cylindrical wall of the horn body.

14. The electronic horn according to claim 13, wherein the three first sound amplifying chambers and the second sound amplifying chamber meander back-and-forth in the first and second directions.

15. The electronic horn according to claim 12, wherein the three first sound amplifying chambers and the second sound amplifying chamber meander back-and-forth in the first and second directions.

16. The electronic horn according to claim 9, wherein the intermediate element and the circular cover both have a circular outer periphery.

17. The electronic horn according to claim 9, further comprising:

a horn body having a cylindrical wall and a recessed support surface extending radially inward and perpendicular from the cylindrical wall, wherein:

an outer peripheral end portion of the plate-shaped oscillator is clamped between the intermediate element and the recessed support surface of the horn body, and an outer peripheral edge of the plate-shaped oscillator is spaced apart from the cylindrical wall of the horn body.

18. An electronic horn comprising:

a plate-shaped oscillator;

a piezoelectric element configured to excite the oscillator;

an intermediate element defining at least (i) a resonator having an opening and (ii) an inner cylinder surrounding the opening and projecting in a first direction, the resonator at least partially covering one side of the oscillator, a resonance space being defined between a first side of the resonator and the oscillator, and a buffer chamber being defined by a second side of the resonator and the inner cylinder;

at least one first sound amplifying chamber in fluid communication with the buffer chamber and being configured to amplify and guide a warning sound generated by the oscillator, the at least one first sound amplifying chamber having a first portion extending in the first direction and a second portion in fluid communication with the first portion that causes the warning sound to move in a second direction, the second portion being disposed at least partially radially outward of the first portion; and a second sound amplifying chamber disposed at least partially radially outward of the at least one first sound amplifying chamber and being configured further amplify and guide the warning sound from the at least one first sound amplifying chamber, the second sound amplifying chamber having a first portion that receives the warning sound moving in the second direction and a second portion in fluid communication with the first portion that causes the warning sound to move in the first direction, the second portion being disposed at least partially radially outward of the first portion;

wherein the at least one first sound amplifying chamber comprises three first sound amplifying chambers in series that inversely curve in the first and second directions before reaching the second sound amplifying chamber.

19. The electronic horn according to claim 18, wherein the three first sound amplifying chambers and the second sound amplifying chamber meander back-and-forth in the first and second directions.

20. The electronic horn according to claim 19, further comprising:

a conical outer housing disposed radially outward of the inner cylinder and at least partially defining the second portion of the second sound amplifying chamber; and a circular cover covering the inner cylinder and at least partially covering the outer conical housing in the first direction;

wherein the buffer chamber, the three first sound amplifying chambers, and the second sound amplifying chamber are defined by the cover and the walls of the inner cylinder and the outer conical housing such that the three first sound amplifying chambers and the second sound amplifying chamber extend around an entire circumference of the opening of the resonator.

21. The electronic horn according to claim 18, further comprising:

a horn body having a cylindrical wall and a recessed support surface extending radially inward and perpendicular from the cylindrical wall;

wherein:

an outer peripheral end portion of the plate-shaped oscillator is clamped between the intermediate element and the recessed support surface of the horn body; and an outer peripheral edge of the plate-shaped oscillator is spaced apart from the cylindrical wall of the horn body.

* * * * *